United States Patent [19]

Chan et al.

[11] Patent Number: 4,608,154

[45] Date of Patent: Aug. 26, 1986

[54] PROCESS FOR THE FLOTATION OF INSOL FROM SYLVINITE ORE

[75] Inventors: Simon Chan; Eli Slorstad; Henry D. A. Cormode; Richard R. Tamosiunis, all of Saskatoon, Canada

[73] Assignee: Cominco Ltd., Vancouver, Canada

[21] Appl. No.: 673,253

[22] Filed: Nov. 20, 1984

[30] Foreign Application Priority Data

Nov. 22, 1983 [CA] Canada ..... 441,653

[51] Int. Cl.[4] ..... B03D 1/02

[52] U.S. Cl. ..... 209/166; 252/61

[58] Field of Search ..... 209/5, 166, 167; 252/61

[56] References Cited

U.S. PATENT DOCUMENTS

| | | | |
|---|---|---|---|
| 3,596,763 | 8/1971 | Wittelsheim et al. | 209/166 |
| 3,805,951 | 4/1974 | Brogoitti et al. | 209/5 |
| 4,192,737 | 3/1980 | Thompson et al. | 209/166 |
| 4,198,288 | 4/1980 | Levine et al. | 209/166 |

FOREIGN PATENT DOCUMENTS

| | | | |
|---|---|---|---|
| 579105 | 7/1959 | Canada | 209/166 |

*Primary Examiner*—Bernard Nozick

*Attorney, Agent, or Firm*—Gowling & Henderson

[57] ABSTRACT

Insolubles are removed from sylvinite ores by froth flotation using a small amount of a primary, secondary or primary-ether alkyl amine as collector in combination with a flocculant. In the case of a primary alkyl amine, the collector may be the same as the collector used in the subsequent froth flotation to recover sylvite from the ore.

25 Claims, No Drawings

PROCESS FOR THE FLOTATION OF INSOL FROM SYLVINITE ORE

This invention relates to the flotation of potash ores and, more particularly, to a process for the froth flotation of insolubles from sylvinite ores.

In the recovery of sylvite from potash ores such as occur, for example, in Canada and the United States, it is usually necessary to remove extraneous materials such as clays, dolomite, anhydrite, hematite and other materials, preferably prior to the flotation separation of sylvite from other potash ore components. The removal of extraneous materials, commonly referred to as slimes or insolubles, has been done by hydroseparation processes and by flotation. In flotation methods, an ore pulp is usually first subjected to a scrubbing operation to liberate the insolubles, referred to hereinafter as insol, and the scrubbed ore pulp is then conditioned with one or more reagents which enhance the removal of insol. The conditioned pulp is subjected to froth flotation whereby a portion of the insol is removed. Flocculants may be used to improve the separation. After the partial removal of the insol, the ore pulp is usually treated with a blinding agent to inactivate residual insol, conditioned with reagents and subjected to froth flotation for the recovery of sylvite from other potash ore components.

It is now a generally accepted fact, as witnessed by the many statements made in the prior art, that the collector reagents used for the flotation of sylvite, such as primary aliphatic amines, are also consumed by the insol and that the use of such reagents, without prior removal of insol, leads to very high reagent consumption and to high losses of sylvite with the insol. Hence, many flotation reagents, i.e. collectors, have been developed for the specific purpose of selectively removing insol without incurring the high losses of sylvite. These specifically tailored reagents are usually expensive and add considerably to the operating costs.

It has now surprisingly been found that, contrary to all prior art statements, insol can be removed from sylvinite ores by using the same collector as used for the flotation of sylvite without high consumption of this collector and without high losses of sylvite with the insol.

More specifically, it has been found that a relatively small amount of a primary aliphatic amine having from 8 to 24 carbon atoms together with a small amount of flocculant can selectively condition the insol in a potash ore pulp and the conditioned insol can be selectively removed by froth flotation. The resulting potash ore pulp can then be conditioned with the usual amount of the same primary aliphatic amine and the conditioned ore pulp subjected to froth flotation for the recovery of sylvite. It has also been found that a relatively small amount of a secondary aliphatic amine having from 12 to 20 carbon atoms, or a primary ether aliphatic amine having from 8 to 16 carbon atoms can selectively condition the insol, which can be selectively removed by froth flotation. The resulting potash ore pulp can then be conditioned with the usual amount of primary aliphatic amine and the conditioned pulp subjected to froth flotation for the recovery of sylvite. The term "aliphatic" used herein shall means "alkyl", as defined in the Dictionary of Scientific and Technical Terms, published by McGraw-Hill.

The collectors of the present invention are relatively inexpensive, no specially tailored and expensive collectors are needed for the insol flotation and the process can be carried out simply and much more economically than heretofore possible. Considerable savings in the cost for reagents are realized. In the following, amounts of reagents are given in g/t (grams per metric tonne) of ore.

It is a principal object of the present invention to provide a process for the flotation of insol from potash ore using amines.

It is another object to provide a process for the flotation of insol from potash ore using a collector chosen from primary aliphatic amines, primary ether aliphatic amines and secondary amines.

It is a further object to float insol from potash ore using the same amine collector as in the flotation for the recovery of sylvite.

It is still another object to reduce reagent costs without reducing the flotation efficiency.

These and other objects will become apparent from the detailed description of the process of the invention.

Accordingly, there is provided a process for the flotation of insol from sylvinite ore which process comprises the steps of pulping the ore; conditioning the ore pulp with an aliphatic amine collector for insol chosen from the group consisting of primary aliphatic amines, secondary aliphatic amines, and primary ether amines, said aliphatic amine collector for insol being added in an amount of at least 0.4 g collector per tonne of ore, and with a suitable flocculant added in an amount of at least about 5 g flocculant per tonne of ore; subjecting the conditioned ore pulp to froth flotation; and removing the floated insol. More particularly, the process for the flotation of insol from sylvinite ore comprises the steps of pulping the ore in saturated brine; conditioning the ore pulp with an aliphatic amine collector for insol chosen from the group consisting of primary aliphatic amines having a number of carbon atoms in the range of about 8 to 24, secondary aliphatic amines having a number of carbon atoms in the range of about 12 to 20 and primary ether aliphatic amines having a number of carbon atoms in the range of about from 6 to 18, said aliphatic amine collector being added in an amount of at least about 0.4 g collector per tonne of ore and with a suitable flocculant added in an amount of at least about 5 g per tonne of ore; subjecting the treated ore pulp to froth flotation; and removing the floated insol.

According to another embodiment, there is provided a process for the flotation of sylvite from sylvinite ores including using primary aliphatic amines as collector for sylvite, said amines having a number of carbon atoms in the range of about 8 to 24 and used in an amount in the range of 20 to 500 g collector per tonne of ore, characterized by removing insol from said sylvinite ore prior to said flotation of sylvite by froth flotation of said insol in the presence of said primary aliphatic amine collector in an amount in the range of about 0.4 to 25 g collector per tonne of ore and in the presence of an acrylamide polymer flocculant in an amount of at least about 5 g flocculant per tonne of ore.

Preferably, the primary aliphatic amine collector is the same as the collector used in the flotation of sylvite from other sylvinite ore components, and said collector comprises primary aliphatic amines having from 12 to 24 carbon atoms. Preferably, the primary aliphatic amine collector comprises primary amines having from 8 to 16, most preferably 12 to 14, carbon atoms. Preferably, the aliphatic amine collector comprises secondary aliphatic amines having from 14 to 18 carbon atoms.

Preferably, the aliphatic amine collector comprises primary ether amines having from 10 to 16 carbon atoms. Preferably the amount of aliphatic amine collector in the flotation of insol is in the range of about 0.8 to 10 g/t of ore, more preferably, the amount is in the range of about 1 to 7 g/t of ore and, most preferably, the amount is about 3 g/t of ore. Preferably, the flocculant is an acrylamide polymer added to the flotation of insol in an amount in the range of about 5 to 60 g/t of ore, preferably about 15 to 45 g/t. Normally the flotation of insol is carried out in two stages, preferably two consecutive stages, wherein an amount of amine collector for insol in the range of about 0.5 to 1.5 g/t and an amount of acrylamide polymer flocculant in the range of about 10 to 20 g/t are added in the first stage, and an amount of amine collector for insol in the range of about 0.5 to 1.5 g/t and an amount of acrylamide polymer flocculant in the range of about 5 to 10 g/t are added in the second stage.

The process of the present invention will now be described in detail.

Potash ore, i.e. sylvinite ore, usually comprising sylvite, halite and, depending on the ore, varying amounts of insol, is comminuted and the comminuted ore is fed to a slurry vessel where saturated brine, usually recycled from other potash process steps, is added to make an ore pulp which is subjected to a scrubbing operation to liberate the insol from the ore. The ore pulp from the scrubbing operation is then fed to an insol conditioner.

To the conditioner is added an amine as collector for the insol. The amine collector for the insol may be chosen from the group of aliphatic amines consisting of primary aliphatic amines, secondary aliphatic amines and primary ether aliphatic amines. The primary aliphatic amine collector may be a single compound, but is usually a mixture of amines, having a number of carbon atoms in the range of about 8 to 24. For example, primary aliphatic amines such as sold under the trade marks Armeen HT ® and Armeen HR ®, which comprise amines having carbon atoms in the range of about 12 to 24, are suitable for the selective flotation of insol from potash ore. Such amines are similar to or may be the same as the amine collectors used in the subsequent flotation of sylvite from other potash ore components such as halite. Insol can also be effectively floated from potash ore using primary aliphatic amines which have a number of carbon atoms in the range of about 8 to 16 such as, e.g., sold under the trade mark Adogen ® 163D, which comprises amines having a number of carbon atoms in the range of about 10 to 14. The suitable secondary aliphatic amines, i.e. usually those in liquid form, may have a number of carbon atoms in the range of about 12 to 20, such as for example Adogen ® 240, which has amines having a number of carbon atoms in the range of about 14 to 18. The suitable primary ether aliphatic amines may have a number of carbon atoms in the range of about 6 to 18 such as, for example, sold under the trade mark Adogen ® 185, which comprises amines having a number of carbon atoms in the range of about 10 to 16. When using the secondary or primary ether or the shorter chain primary amines in the flotation of insol, the longer chain primary amines are used in subsequent potash flotation. It is understood that primary, secondary or primary-ether amines may be used that are similar to the specific amines recited above and which may have different chain length distributions but yield similar results.

The aliphatic amine collector is preferably added as a dilute solution, such as for example a 0.1–5% solution. The effective amount of collector that must be added varies with the amount of insol in the ore, and generally the aliphatic amine collector for insol is added to the conditioner in an amount of at least about 0.4 g/t of ore. The addition of amounts smaller than about 0.4 g/t results in leaving high residual insol with the ore requiring high additions of blinding agent in subsequent sylvite flotation. The addition of amounts higher than about 25 g/t for primary aliphatic amines having 12 to 24 carbon atoms and higher than about 10 g/t for primary aliphatic amines having 8 to 16 carbon atoms, secondary aliphatic amines and primary ether aliphatic amines results in high reagent consumption and an increased loss of sylvite with the insol. The best results are obtained with an amount of aliphatic amine collector in the range of about 0.8 to 10 g/t of ore, preferably with an amount in the range of about 1 to 7 g/t of ore; the most preferred amount being about 3 g/t. It is obvious that the amounts of amine collector for insol flotation, as used according to the process of the present invention, are considerably smaller than those used in the flotation of sylvite from other potash ore components such as halite, the latter amounts for primary aliphatic amines usually being in the range from 20 to 500 g/t of ore and more commonly in the 40 to 250 g/t range.

The amine collector must be used in combination with a suitable flocculant to effect flotation of insol. The flocculant may be added to the conditioner prior to adding the amine collector or together with the collector. Suitable flocculants are, for example, guar gum and acrylamide polymers. The use of acrylamide polymers as flocculant is preferred. Acrylamide polymers are, for example, obtained from Cyanamid Canada Inc. under the trade mark S-3731, from Allied Colloids (Canada) Inc. under the trade mark E-10, or from Hart Chemicals under the trade mark CFN-20. It is to be understood that flocculants other than guar gum and acrylamide polymers can be used which are similarly effective. The flocculant is added in an amount of at least 5 g/t. The amount of acrylamide polymer flocculant is preferably added in an amount in the range of about 5 to 60 g/t of ore, most preferably in an amount in the range of about 15 to 45 g/t of ore. If desired amounts higher than 60 g/t may be used.

It has been found that the addition of a frother in the flotation of insol is generally unnecessary. In a commercially operated process the brine used to pulp the potash ore is usually recycled from the potash flotation circuits and may contain a residual amount of frother. If desired, a small amount of a suitable frother may be added to the conditioning step in the flotation of insol.

After suitably treating and conditioning the ore pulp with the collector and the flocculant, the conditioned ore pulp is subjected to froth flotation whereby the insol is floated as a concentrate and the tailing contains most of the potash values and some residual insol.

The tailing from the flotation of insol is subsequently treated with a suitable blinding agent such as, for example, starch or guar to inactivate residual insol, and is conditioned with a suitable amount of a collector for sylvite such as a primary aliphatic amine. This primary aliphatic amine for the collection of sylvite may be similar to or the same primary aliphatic amine as used in the flotation of insol. The conditioned tailing is then fed to the potash flotation circuits and subjected to flotation for the recovery of sylvite.

According to a preferred embodiment, the flotation of insol is carried out in two stages, preferably in series. To each conditioning stage is added an amount of aliphatic amine collector for insol chosen from the group consisting of primary aliphatic amines, secondary aliphatic amines and primary ether aliphatic amines, and an amount of flocculant. An insol concentrate is obtained from each flotation stage. The insol concentrates are passed to a thickener and the potash tailing from the second stage insol flotation is passed to the potash flotation circuits for the separation of sylvite from other potash ore components.

In the two-stage flotation for insol, according to this preferred embodiment, scrubbed ore pulp is conditioned in a first conditioning stage with aliphatic amine collector for insol chosen from the group consisting of primary aliphatic amines, secondary aliphatic amines and primary ether aliphatic amines, and having a number of carbon atoms as discussed above, and with an acrylamide polymer flocculant. The conditioned ore pulp is subjected to the first stage froth flotation for the removal of a first concentrate containing insol. The tailing from the first stage froth flotation is conditioned with a second amount of aliphatic amine collector and a second amount of acrylamide polymer flocculant and the so conditioned pulp is subjected to the second stage froth flotation. A second concentrate of insol is removed and passed, together with the insol concentrate from the first stage insol flotation, to a thickener. The second tailing is passed to the flotation circuits for potash wherein sylvite is floated from other potash ore components using a primary aliphatic amine collector. If desired, the primary aliphatic amine collector used in the flotation of sylvite may be similar to or the same collector as used in the flotation of insol. The total amounts of each of the collector for insol and of the flocculant are in the ranges recited hereinabove.

The invention will now be illustrated by means of the following non-limitative examples. (Amounts are given in grams per metric tonne of ore.)

EXAMPLE 1

Sylvinite ore containing 5% insol was treated for the removal of insol by flotation using varying amounts of primary amine. Mine-run ore was comminuted, mixed with saturated brine and the resulting ore pulp was subjected to scrubbing. The scrubbed ore pulp was diluted to 40% solids by adding more brine. Portions of the ore pulp were then conditioned with varying amounts of primary aliphatic amine, a mixture of 50% Armeen HT® and 50% Armeen HR®, and 23 g/t of a polyacrylamide flocculant E-10™ was added. The reagentized ore pulp was subjected to flotation and the insol ate and the tailing were recovered, analyzed and distributions calculated. The results are given in Tables IA and IB.

TABLE IA

| Test No. | Amount of Primary amine in g/t of ore | Assay in % | | | | | |
|---|---|---|---|---|---|---|---|
| | | Feed | | Concentrate | | Tailing | |
| | | $K_2O$ | Insol | $K_2O$ | Insol | $K_2O$ | Insol |
| 1 | 0.5 | 26.21 | 4.57 | 15.68 | 43.06 | 26.57 | 3.26 |
| 2 | 1.5 | 26.26 | 4.71 | 15.92 | 49.93 | 26.74 | 2.63 |
| 3 | 11.0 | 24.20 | 5.00 | 22.53 | 30.58 | 24.33 | 2.58 |

TABLE IA-continued

| Test No. | Amount of Primary amine in g/t of ore | Assay in % | | | | | |
|---|---|---|---|---|---|---|---|
| | | Feed | | Concentrate | | Tailing | |
| | | $K_2O$ | Insol | $K_2O$ | Insol | $K_2O$ | Insol |
| 4 | 22.0 | 24.10 | 5.00 | 23.42 | 33.04 | 24.12 | 2.56 |

TABLE IB

| Test No. | Distribution % | | | | | |
|---|---|---|---|---|---|---|
| | Feed | | Concentrate | | Tailing | |
| | $K_2O$ | Insol | $K_2O$ | Insol | $K_2O$ | Insol |
| 1 | 100 | 100 | 2.0 | 31.1 | 98.0 | 68.9 |
| 2 | 100 | 100 | 2.7 | 46.6 | 97.3 | 53.4 |
| 3 | 100 | 100 | 7.5 | 51.0 | 92.5 | 49.0 |
| 4 | 100 | 100 | 7.1 | 50.3 | 92.9 | 49.7 |

It can be seen from the tabulated results that insol can be effectively removed from potash ore when a primary aliphatic amine is used as a collector for insol. It also follows that an amount of primary amine as low as 0.5 g/t of ore or as high as 22 g/t results in effective removal of insol from potash, the loss of potash in the insol concentrate being very low with small amounts of primary amine, but increasing with somewhat larger amounts.

EXAMPLE 2

In a commercial operation for the recovery of sylvite, mine-run sylvinite ore containing 25.9% $K_2O$ equivalent, 54% NaCl and 5.1% insol was comminuted (94%+200 Tyler mesh) and mixed with recycled saturated brine to form an ore pulp containing 70% solids. The ore pulp was subjected to scrubbing and the scrubbed ore pulp was diluted to 40% solids by adding more brine. The ore pulp was fed to a conditioning launder where 14 g/t of polyacrylamide flocculant E-10™ and 1.5 g/t collector consisting of a blend of 50% Armeen HT® and 50% Armeen HR®, which contain amines with 14 to 24 carbon atoms, were added. The collector was added downstream from the addition point of the flocculant. The reagentized ore pulp was fed to a flotation machine where the insol was floated as concentrate. The tailing was conditioned in a second conditioning launder with 7 g/t of ore of the same flocculant and 1 g/t of ore of the same collector, added downstream from the flocculant. The conditioned tailing was fed to a second flotation machine where the insol was floated as a second concentrate of insol, which was combined with the first concentrate of insol. The combined insol concentrates were passed to a thickener. The tailing from the second flotation machine was fed to the rougher flotation circuit for the separation and recovery of sylvite from other potash components. In the rougher flotation, the same blend of amine collectors was used in an amount of 103 g/t of ore. The recovery of potash from the rougher flotation was 80%.

The feed to the first conditioning launder, the combined concentrates from the insol flotation machines and the tailing from the second flotation machines, i.e. the feed to the rougher flotation circuit, were assayed and the distributions of $K_2O$ and insol determined. The results are given in Table II.

TABLE II

| | Assay in % | | Distribution in % | |
|---|---|---|---|---|
| | $K_2O$ | Insol | $K_2O$ | Insol |
| Feed | 25.9 | 5.1 | 100.0 | 100.0 |

TABLE II-continued

| | Assay in % | | Distribution in % | |
|---|---|---|---|---|
| | $K_2O$ | Insol | $K_2O$ | Insol |
| Insol Concentrate | 17.9 | 41.3 | 6.1 | 71.6 |
| Tailing | 27.0 | 1.6 | 93.9 | 28.4 |

It can be seen from the results that flotation of insol from potash ore with 2.5 g/t of ore of primary aliphatic amine collector and 21 g/t of ore of an acrylamide polymer flocculant gives excellent removal of the insol from potash ore. It is also evident that the flotation of insol from potash ore can be carried out with the same primary amine as used for the flotation of potash.

EXAMPLE 3

Scrubbed ore pulp containing 40% solids as used in Example 2 was subjected to a number of one and two-stage flotation tests using a primary ether amine collector for the insol. Varying amounts of Adogen® - 185, a primary ether aliphatic amine mixture of ether amines having 10 to 16 carbon atoms and of polyacrylamide flocculant E-10 TM, were used. The tests were carried out as the first or the first and second stage as described in Example 2. The amounts of reagents added in each test are given in Table IIIA and the weights, weight percentages, and percentages of $K_2O$ and insol of the insol concentrate and the tailing, and the calculated distributions are given in Table IIIB.

TABLE IIIA

| Test No. | Stages No. | Ether Amine g/t | Flocculant g/t |
|---|---|---|---|
| 1 | 1 | 0.0 | 23.4 |
| 2 | 1 | 1.6 | 23.4 |
| 3 | 1 | 3.2 | 23.4 |
| 4 | 1 | 6.4 | 23.4 |
| 5 | 2 (first) | 4.7 | 23.4 |
| | (second) | 2.3 | 11.7 |
| 6 | 2 (first) | 1.6 | 23.4 |
| | (second) | 0.8 | 11.7 |
| 7 | 2 (first) | 0.8 | 23.4 |
| | (second) | 0.4 | 11.7 |

TABLE IIIB

| Test | | Weight | | $K_2O$ | Insol | Distribution | |
|---|---|---|---|---|---|---|---|
| No. | Fraction | in g | % | % | % | % $K_2O$ | % Insol |
| 1 | insol | 32 | 2.0 | 10.1 | 69.6 | 0.8 | 26.4 |
| | tailing | 1552 | 97.4 | 26.1 | 4.0 | 99.2 | 73.6 |
| | Total | 1594 | 100.0 | | | 100.0 | 100.0 |
| 2 | insol | 41 | 2.6 | 7.1 | 86.1 | 0.7 | 40.0 |
| | tailing | 1552 | 97.4 | 26.1 | 3.4 | 99.3 | 60.0 |
| | Total | 1593 | 100.0 | | | 100.0 | 100.0 |
| 3 | insol | 55 | 3.4 | 12.4 | 59.6 | 1.7 | 36.4 |
| | tailing | 1549 | 96.6 | 25.7 | 3.7 | 98.3 | 63.6 |
| | Total | 1604 | 100.0 | | | 100.0 | 100.0 |
| 4 | insol | 52 | 3.3 | 10.5 | 71.1 | 1.5 | 40.2 |
| | tailing | 1530 | 96.7 | 25.8 | 3.6 | 98.6 | 59.8 |
| | Total | 1582 | 100.0 | | | 100.0 | 100.0 |
| 5 | 1st insol | 58 | 3.6 | 11.6 | 69.2 | 1.6 | 39.6 |
| | 2nd insol | 51 | 3.2 | 17.1 | 40.9 | 2.2 | 20.6 |
| | 2nd tailing | 1496 | 93.2 | 25.9 | 2.7 | 96.2 | 39.8 |
| | Total | 1605 | 100.0 | | | 100.0 | 100.0 |
| 6 | 1st insol | 58 | 3.6 | 11.7 | 70.5 | 1.7 | 37.6 |
| | 2nd insol | 48 | 3.0 | 17.3 | 49.3 | 2.1 | 21.7 |
| | 2nd tailing | 1508 | 93.4 | 25.3 | 2.9 | 96.2 | 40.7 |
| | Total | 1614 | 100.0 | | | 100.0 | 100.0 |
| 7 | 1st insol | 37 | 2.3 | 15.3 | 75.0 | 1.4 | 29.9 |
| | 2nd insol | 29 | 1.8 | 21.5 | 48.8 | 1.5 | 15.2 |
| | 2nd tailing | 1543 | 95.9 | 26.0 | 3.3 | 97.1 | 54.9 |
| | Total | 1609 | 100.0 | | | 100.0 | 100.0 |

It can be seen from the tabulated results that insol can be effectively removed from potash ore when a primary ether aliphatic amine is used as a collector for insol in amounts from 0.4 to 7 g/t.

EXAMPLE 4

Scrubbed ore pulp, as used in Example 2, was subjected to two-stage flotation using a primary aliphatic amine collector for the insol. The primary amine was Adogen® 163D which is a mixture of primary aliphatic amines having 10 to 14 carbon atoms. The test was carried out as in Example 2. In the first stage 3.2 g/t primary amine and 23.4 g/t polyacrylamide flocculant and in the second stage 1.6 g/t and 11.7 g/t, respectively, were added. The analyses and distributions are given in Table IV.

TABLE IV

| | Weight | | $K_2O$ | Insol | Distribution | |
|---|---|---|---|---|---|---|
| | in g | % | % | % | $K_2O$ % | % Insol |
| first insol | 28 | 1.7 | 5.9 | 85.6 | 0.4 | 24.6 |
| second insol | 48 | 3.0 | 12.0 | 60.7 | 1.5 | 29.9 |
| tailing | 1528 | 95.3 | 25.5 | 2.9 | 98.1 | 45.5 |
| Total | 1604 | 100.0 | | | 100.0 | 100.0 |

It follows from the results that insol can be effectively floated from potash by using a primary aliphatic amine collector containing relatively short-chain amines.

EXAMPLE 5

Scrubbed ore pulp, as used in Example 2, was subject to two-stage flotation tests for insol as described in Example 2, but using a secondary aliphatic amine collector for the insol. Varying amounts of Adogen® 240, a secondary aliphatic amine mixture containing secondary amines having 14 to 18 carbon atoms and of polyacrylamide flocculant E-10 TM were used. The amounts of reagents added are given in Table VA and the weights, percentages and the calculated distributions are given in Table VB.

TABLE VA

| Test No. | Stages | Secondary Amine g/t | Flocculant g/t |
|---|---|---|---|
| 1 | 1 | 0.0 | 23.4 |
| 2 | 2 (first) | 1.6 | 23.4 |
| | (second) | 0.8 | 11.7 |
| 3 | 2 (first) | 3.2 | 23.4 |
| | (second) | 1.6 | 11.7 |
| 4 | 2 (first) | 6.4 | 23.4 |
| | (second) | 3.2 | 11.7 |

TABLE VB

| Test | | Weight | | $K_2O$ | Insol | Distribution | |
|---|---|---|---|---|---|---|---|
| No. | Fraction | in g | % | % | % | % $K_2O$ | % Insol |
| 1 | insol | 23 | 1.4 | 12.5 | 58.4 | 0.4 | 22.2 |
| | tailing | 2566 | 98.6 | 25.8 | 3.0 | 99.6 | 77.8 |
| | Total | 1589 | 100.0 | | | 100.0 | 100.0 |
| 2 | 1st insol | 28 | 1.8 | 11.5 | 63.1 | 0.8 | 23.2 |
| | 2nd insol | 48 | 3.0 | 16.3 | 40.4 | 1.9 | 25.4 |

TABLE VB-continued

| Test No. | Fraction | Weight in g | Weight % | $K_2O$ % | Insol % | Distribution % $K_2O$ | Distribution % Insol |
|---|---|---|---|---|---|---|---|
| | tailing | 1509 | 95.2 | 26.1 | 2.6 | 97.3 | 51.4 |
| | Total | 1585 | 100.0 | | | 100.0 | 100.0 |
| 3 | 1st insol | 27 | 1.7 | 8.1 | 72.4 | 0.5 | 25.9 |
| | 2nd insol | 48 | 3.1 | 14.6 | 47.9 | 1.8 | 30.5 |
| | tailing | 1495 | 95.2 | 26.1 | 2.2 | 97.7 | 43.6 |
| | Total | 1570 | 100.0 | | | 100.0 | 100.0 |
| 4 | 1st insol | 41 | 2.5 | 10.6 | 63.2 | 1.1 | 32.2 |
| | 2nd insol | 58 | 3.6 | 16.8 | 31.8 | 2.4 | 22.9 |
| | tailing | 1509 | 93.9 | 26.1 | 2.4 | 96.5 | 44.9 |
| | Total | 1608 | 100.0 | | | 100.0 | 100.0 |

It can be seen from the results that insol can be floated from potash ore with a secondary amine as collector.

It is understood that variations and modifications can be made in the process according to the invention without departing from the spirit and scope of the invention as defined by the claims.

What we claim as new and desire to protect by Letters Patent of the United States is:

1. A process for the selective flotation of insol containing clays, dolomite, anhydrite and hematite from a sylvinite ore which process comprises the steps of pulping the ore; conditioning the ore pulp with an alkyl amine collector for insol chosen from the group consisting of primary alkyl amines, secondary alkyl amines, and primary ether alkyl amines, said alkyl amine collector for insol being added in an amount in the range of about 0.4 to 10 g collector per tonne of ore, and with a suitable flocculant added in an amount of at least about 5 g flocculant per tonne of ore; subjecting the conditioned ore pulp to froth flotation; and removing the flotated insol.

2. A process as claimed in claim 1 wherein the alkyl amine collector for insol comprises secondary alkyl amines having a number of carbon atoms in the range of about 14 to 18.

3. A process as claimed in claim 1 wherein the alkyl amine collector for insol comprises primary ether amines having a number of carbon atoms in the range of about 10 to 16.

4. A process as claimed in claim 1 wherein the alkyl amines collector for insol comprises primary alkyl amines having a number of carbon atoms in the range of about 8 to 16.

5. A process as claimed in claim 4 wherein the amount of the primary alkyl amine is in the range of about 0.8 to 10 g/t.

6. A process as claimed in claim 1 wherein the alkyl amines collector for insol comprises primary alkyl amines having a number of carbon atoms in the range of about 10 to 14.

7. A process as claimed in claim 6 wherein the amount of the primary alkyl amine is in the range of about 0.8 to 10 g/t.

8. A process as claimed in claim 1 wherein the sylvinite ore is pulped in saturated brine and said primary alkyl amines have a number of carbon atoms in the range of about 8 to 24, said secondary alkyl amines have a number of carbon atoms in the range of about 12 to 20 and said primary ether amines have a number of carbon atoms in the range of about 6 to 18.

9. A process as claimed in claim 8 wherein the flocculant is an acrylamide polymer flocculant and said flocculant is added to the flotation of insol in an amount in the range of about 5 to 60 g/t.

10. A process as claimed in claim 8 wherein the flocculant is an acrylamide polymer flocculant and said flocculant is added to the flotation of insol in an amount in the range of about 15 to 45 g/t.

11. A process as claimed in claim 8 wherein the flotation of insol is carried out in two stages.

12. A process as claimed in claim 8 wherein the flotation of insol is carried out in two consecutive stages, an amount of alkyl amine collector for insol in the range of about 0.5 to 1.5 g/t and an amount of acrylamide polymer flocculant in the range of about 10 to 20 g/t are added in the first stage, and an amount of amine collector for insol in the range of about 0.5 to 1.5 g/t and an amount of acrylamide polymer flocculant in the range of about 5 to 10 g/t are added in the second stage.

13. A process as claimed in claim 8 wherein the alkyl amine collector for insol is added in an amount in the range of about 0.8 to 10 g/t.

14. A process as claimed in claim 8 wherein the primary alkyl amine collector for insol is added in an amount in the range of about 1 to 7 g/t.

15. A process as claimed in claim 8 wherein the alkyl amine collector for insol is added in an amount of about 3 g/t.

16. A process as claimed in claim 8 wherein the primary alkyl amine collector is the same collector as is used in the flotation of sylvite from other sylvinite ore components and wherein said collector comprises primary alkyl amines having a number of carbon atoms in the range of about 12 to 24.

17. A process for the flotation of sylvite from sylvinite ores including using primary alkyl amines as collector for sylvite, said amines having a number of carbon atoms in the range of about 8 to 24 carbon atoms and used in an amount in the range of 20 to 500 g collector per tonne of ore, comprising selectively removing insol containing clays, dolomite, anhydrite and hematite from said sylvinite ore prior to said flotation of sylvite by froth flotation of said insol in the presence of said primary alkyl amine collector in an amount in the range of about 0.4 to 20 g collector per tonne of ore and in the presence of an acrylamide polymer flocculant in an amount of at least about 5 g flocculant per tonne of ore.

18. A process as claimed in claim 17 wherein the alkyl amine collector for insol is added in an amount in the range of about 0.8 to 10 g/t.

19. A process as claimed in claim 17 wherein the alkyl amine collector for insol is added in an amount in the range of about 1 to 7 g/t.

20. A process as claimed in claim 17 wherein the alkyl amine collector for insol is added in an amount of about 3 g/t.

21. A process as claimed in claim 17 wherein the primary alkyl amine collector is the same collector as is used in the flotation of sylvite from other sylvinite ore components and wherein said collector comprises primary alkyl amines having a number of carbon atoms in the range of about 12 to 24.

22. A process as claimed in claim 17 wherein the flocculant is an acrylamide polymer flocculant and said flocculant is added to the flotation of insol in an amount in the range of about 5 to 60 g/t.

23. A process as claimed in claim 17 wherein the flocculant is an acrylamide polymer flocculant and said flocculant is added to the flotation of insol in an amount in the range of about 15 to 45 g/t.

24. A process as claimed in claim 17 wherein the flotation of insol is carried out in two stages.

25. A process as claimed in claim 17 wherein the flotation of insol is carried out in two consecutive stages, an amount of alkyl amine collector for insol in the range of about 0.5 to 1.5 g/t and an amount of acrylamide polymer flocculant in the range of about 10 to 20 g/t are added in the first stage, and an amount of amine collector for insol in the range of about 0.5 to 1.5 g/t and an amount of acrylamide polymer flocculant in the range of about 5 to 10 g/t are added in the second stage.

* * * * *